US009063474B2

(12) United States Patent
Ueno et al.

(10) Patent No.: US 9,063,474 B2
(45) Date of Patent: Jun. 23, 2015

(54) TRANSFER DEVICE AND IMAGE FORMING APPARATUS INCLUDING THE SAME

(71) Applicant: KYOCERA DOCUMENT SOLUTIONS INC., Osaka (JP)

(72) Inventors: Daijiro Ueno, Osaka (JP); Yasuyuki Fukunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/089,390

(22) Filed: Nov. 25, 2013

(65) Prior Publication Data

US 2014/0147147 A1 May 29, 2014

(30) Foreign Application Priority Data

Nov. 26, 2012 (JP) ..... 2012-257216

(51) Int. Cl.
*G03G 15/01* (2006.01)
*G03G 15/16* (2006.01)

(52) U.S. Cl.
CPC ..... *G03G 15/161* (2013.01); *G03G 2215/0193* (2013.01); *G03G 15/0136* (2013.01)

(58) Field of Classification Search
CPC ..... G03G 15/161; G03G 15/0131; G03G 15/0136; G03G 15/1615; G03G 15/0178; G03G 2215/0193; G03G 2215/0119
USPC ..... 399/299, 66, 302, 298
See application file for complete search history.

(56) References Cited

U.S. PATENT DOCUMENTS

2007/0286628 A1* 12/2007 Kayahara et al. ..... 399/66
2009/0317146 A1* 12/2009 Ohtsuki ..... 399/299
2012/0251193 A1* 10/2012 Ohashi et al. ..... 399/299
2013/0114966 A1* 5/2013 Takahashi et al. ..... 399/299 X

FOREIGN PATENT DOCUMENTS

JP 2007-033938 A 2/2007
JP 2008-129448 A 6/2008
JP 2009-122391 A 6/2009
JP 2011-039378 A 2/2011

OTHER PUBLICATIONS

An Office Action; "Notice of Reason for Rejection," issued by the Japanese Patent Office on Nov. 11, 2014, which corresponds to Japanese Patent Application No. 2012-257216 and is related to U.S. Appl. No. 14/089,390.

* cited by examiner

*Primary Examiner* — Sophia S Chen
(74) *Attorney, Agent, or Firm* — Studebaker & Brackett PC

(57) ABSTRACT

A transfer device includes a plurality of transfer members and a switch section. The switch section, in a first state, causes the transfer members to be pressed against a plurality of image bearing members. The switch section, in a second state, causes a transfer member opposed to a first image bearing member to be pressed against the first image bearing member, and causes a transfer member opposed to a second image bearing member to be separated from the second image bearing member. In the first state, toner images of different colors are transferred from the image bearing members to an intermediate transfer belt and superimposed together. In the second state, a single-color toner image is transferred from the first image bearing member to the intermediate transfer belt. The switch section changes a pressing force of the transfer member to the first image bearing member between the first and second states.

10 Claims, 9 Drawing Sheets

TRANSFER DEVICE AND IMAGE FORMING APPARATUS INCLUDING THE SAME

INCORPORATION BY REFERENCE

The present application claims priority under 35 U.S.C. §119 to Japanese Patent Application No. 2012-257216, filed Nov. 26, 2012. The contents of this application are incorporated herein by reference in their entirety.

BACKGROUND

The present disclosure relates to transfer devices for transferring a toner image to a sheet, and image forming apparatuses including such a transfer device.

Among the known technologies of transferring a toner image to a sheet is a transfer device which utilizes an intermediate transfer belt. The intermediate transfer belt is wound between a drive roller and a driven roller with tension being exerted on the intermediate transfer belt. The intermediate transfer belt is driven and rotated. The intermediate transfer belt is made contact with a plurality of photosensitive drums. Each of the photosensitive drums bears a toner image. As a result, a plurality of toner images are transferred to and superimposed together on a surface of the intermediate transfer belt.

A plurality of primary transfer rollers are provided inside the intermediate transfer belt, facing the photosensitive drums. A primary transfer nip is formed by the primary transfer roller being pressed against the photosensitive drum. A toner image is transferred to the intermediate transfer belt at the primary transfer nip.

When the photosensitive drum is installed and removed, the primary transfer roller is separated from the photosensitive drum so that the photosensitive drum and the intermediate transfer belt may be prevented from rubbing against each other.

SUMMARY

A transfer device according to an aspect of the present disclosure includes an intermediate transfer belt, a housing, a plurality of transfer members, and a switch section. The intermediate transfer belt is opposed to a plurality of image bearing members configured to bear toner images of different colors on circumferential surfaces thereof, and causes the toner images of different colors to be transferred from the plurality of image bearing members to a surface thereof and superimposed together. The housing rotatably supports the intermediate transfer belt. The plurality of transfer members are each pressed against a corresponding one of the plurality of image bearing members with the intermediate transfer belt being interposed therebetween, thereby transferring the toner images from the plurality of image bearing members to the intermediate transfer belt. The switch section, in a first state, causes the plurality of transfer members to be pressed against the plurality of image bearing members. The switch section, in a second state, causes a first one of the plurality of transfer members opposed to a first one of the plurality of image bearing members to be pressed against the first image bearing member. In the second state, the switch section separates a second one of the plurality of transfer members opposed to a second one other than the first one of the plurality of image bearing members from the second image bearing member. The first state is a state in which the toner images of different colors are transferred from the plurality of image bearing members to the intermediate transfer belt and superimposed together. The second state is a state in which a single-color toner image is transferred from the first image bearing member to the intermediate transfer belt. The switch section includes a pressing force adjuster. The pressing force adjuster changes a pressing force of the first transfer member to the first image bearing member between the first and second states.

An image forming apparatus according to another aspect of the present disclosure includes the transfer device of the above aspect, the above image bearing members, and a sheet transfer member. The sheet transfer member transfers, from the intermediate transfer belt to a sheet, the toner images of different colors transferred to and superimposed on the intermediate transfer belt or the single-color toner image transferred to the intermediate transfer belt.

DETAILED DESCRIPTION

An image forming apparatus according to an embodiment of the present disclosure will now be described in detail with reference to the accompanying drawings. In this embodiment, a tandem color printer is illustrated as an example of the image forming apparatus. Alternatively, the image forming apparatus may be, for example, a photocopier, a fax machine, or a multifunction peripheral having the functionality of these devices.

Figure 1:
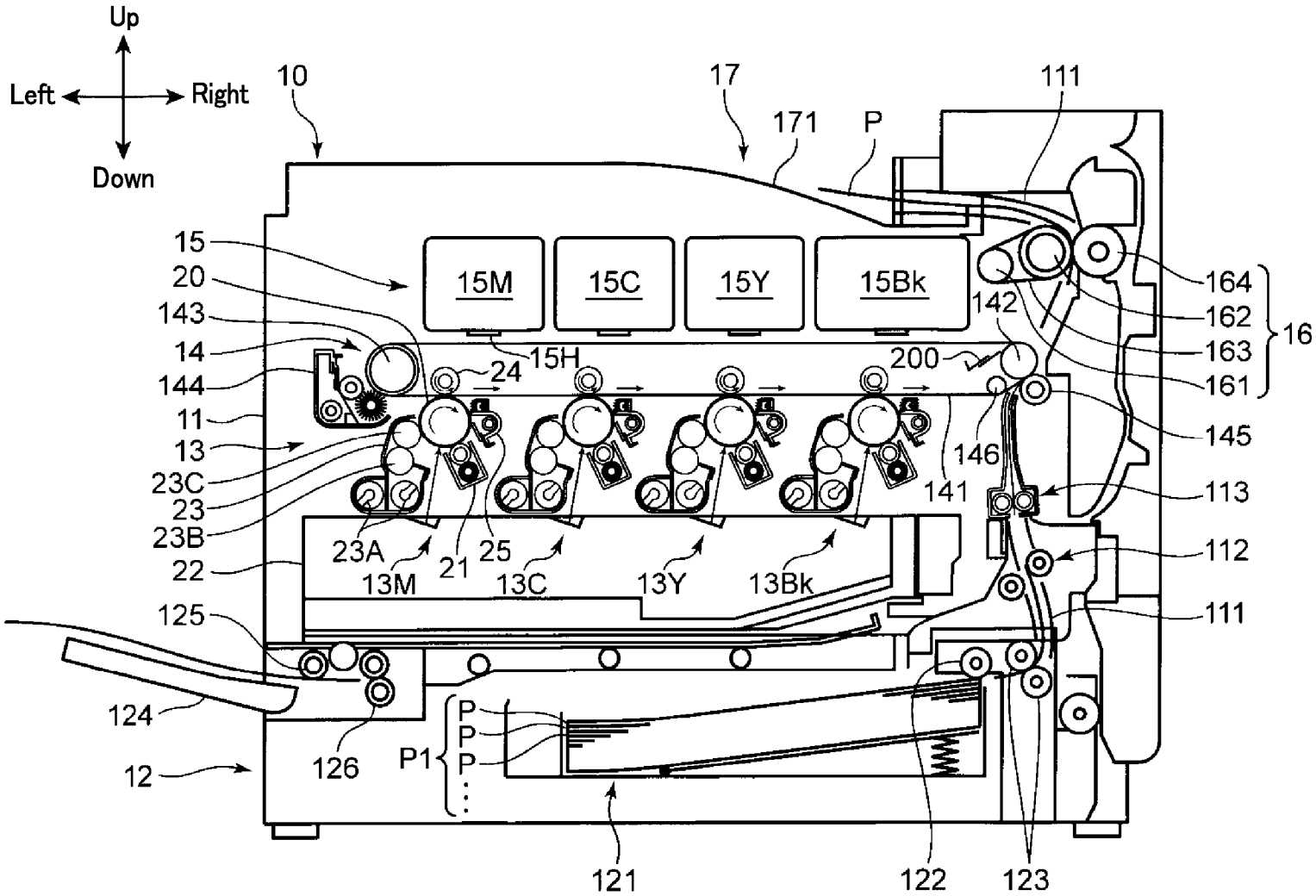
FIG. 1 is a cross-sectional view showing an internal structure of an image forming apparatus according to an embodiment of the present disclosure.
Figure 2:
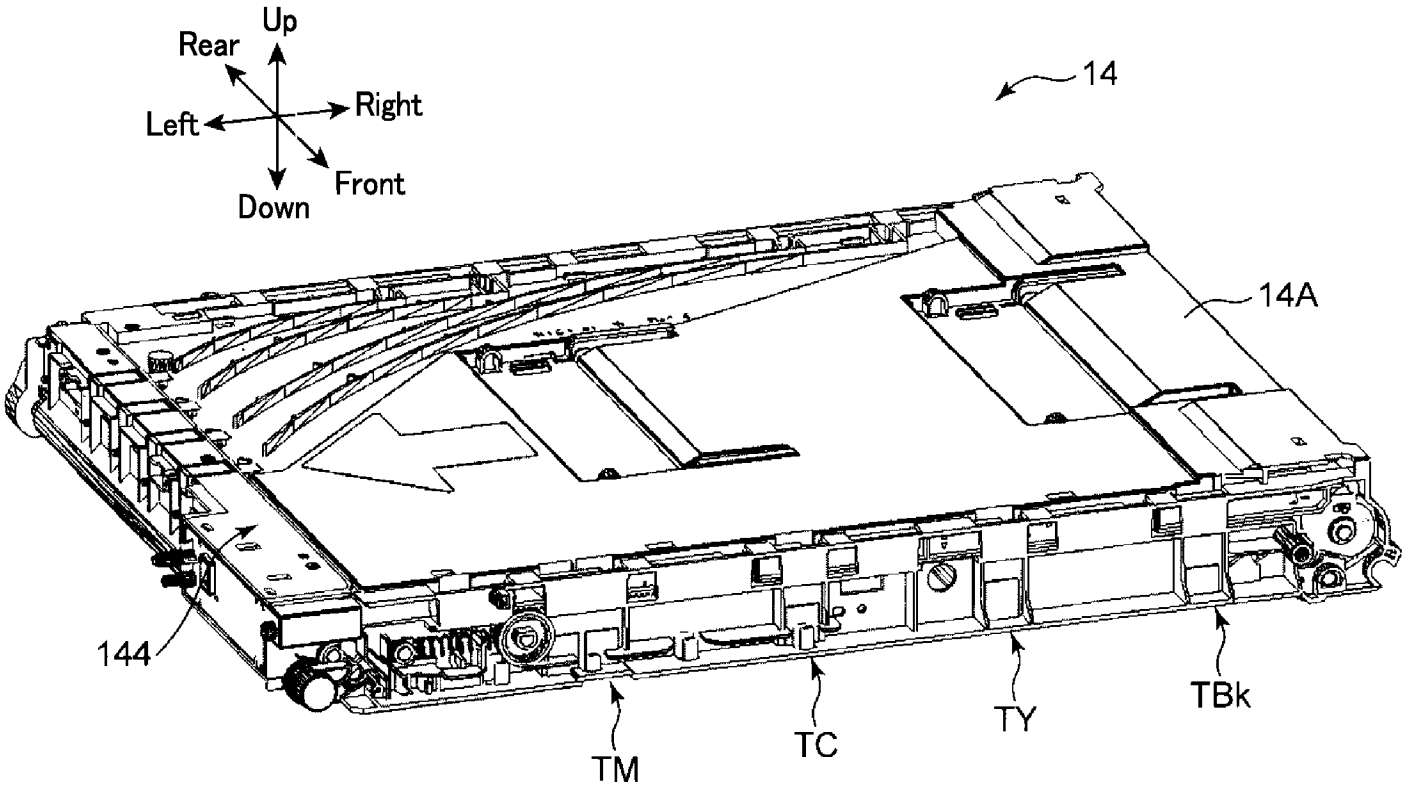
FIG. 2 is a perspective view showing an intermediate transfer unit according to the embodiment of the present disclosure.

FIG. 1 is a cross-sectional view showing an internal structure of the image forming apparatus 10. FIG. 2 is a perspective view showing an intermediate transfer unit 14 shown in FIG.

Figure 3:
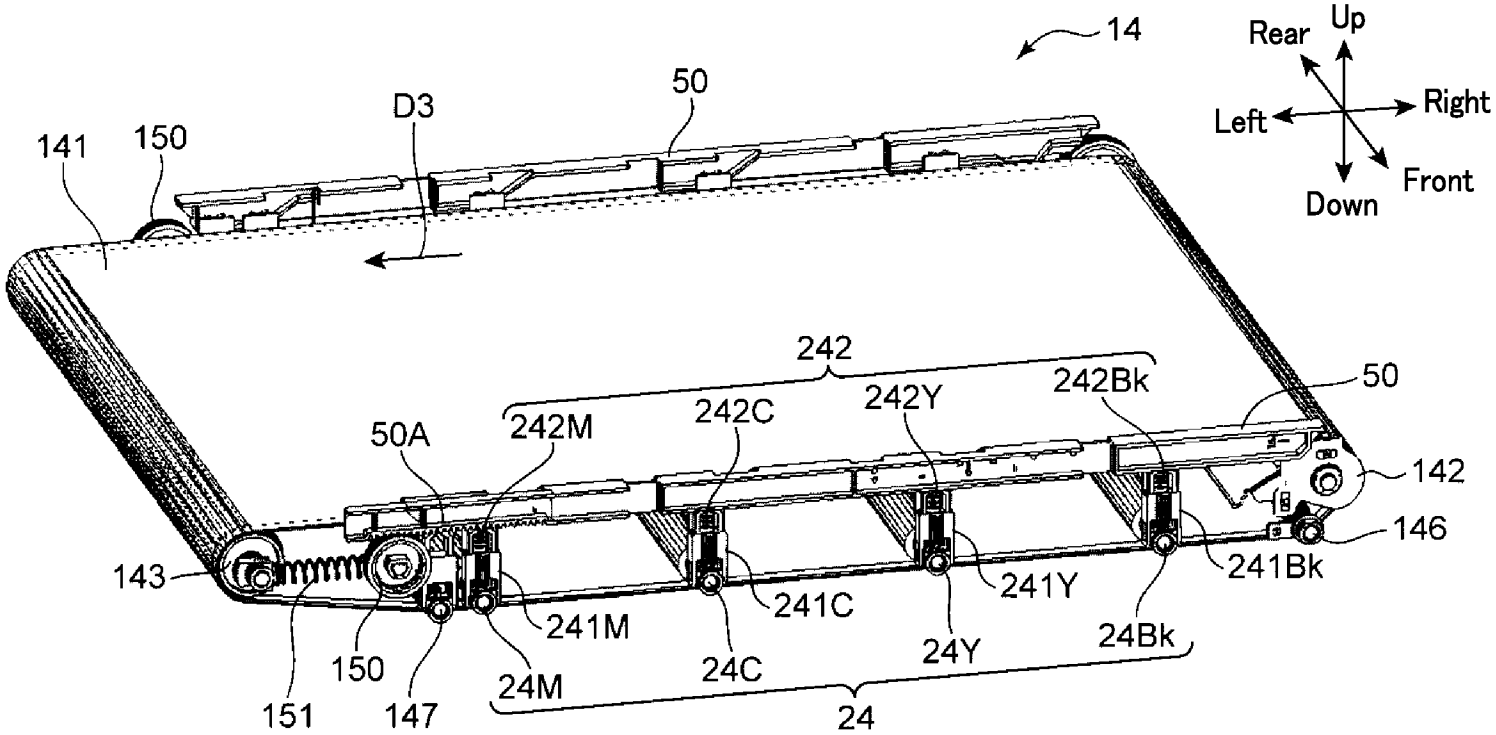
FIG. 3 is a perspective view showing an internal structure of the intermediate transfer unit of the embodiment of the present disclosure.

1. FIG. 3 is a perspective view showing an internal structure of the intermediate transfer unit 14.

The image forming apparatus 10 includes an apparatus body 11. The apparatus body 11 has a box-shaped housing structure. In the apparatus body 11, a paper feeder 12, an image forming section 13, an intermediate transfer unit 14 (transfer device), a toner replenisher 15, and a fixing section 16 are provided. A paper output section 17 is provided at an upper portion of the apparatus body 11.

The paper feeder 12 feeds a sheet P. The image forming section 13 forms a toner image which is to be transferred to the sheet P fed from the paper feeder 12. The toner image is primarily transferred to the intermediate transfer unit 14. The toner replenisher 15 adds a new supply of toner to the image forming section 13. The fixing section 16 performs a process of fixing the unfixed toner image formed on the sheet P to the sheet P (fixing process). The sheet P on which the toner image has been fixed by the fixing section 16 is discharged to the paper output section 17.

A control panel (not shown) is provided at an upper surface of the apparatus body 11. The control panel is a device for inputting various pieces of information, such as output conditions for the sheet P, etc. The control panel includes a power key, a touch screen, and various operation keys. The touch screen is used to input various pieces of information, such as output conditions for the sheet P, etc., depending on touch operation.

In the apparatus body 11, a sheet transport path 111 is formed. The sheet transport path 111 is provided to the right of the image forming section 13, extending vertically. A transport roller pair 112 is provided in the sheet transport path 111. The transport roller pair 112 transports the sheet P. A registration roller pair 113 is also provided in the apparatus body 11. The registration roller pair 113 corrects skew of the sheet P, and feed the sheet P to a secondary transfer nip portion described below with predetermined timing. The registration roller pair 113 is provided upstream of the secondary transfer nip portion (described below) in the sheet transport path 111. The sheet transport path 111 causes the sheet P to be transported from the paper feeder 12 through the image forming section 13 and the fixing section 16 to the paper output section 17.

The paper feeder 12 includes a feed tray 121, a pickup roller 122, and a feed roller pair 123. The feed tray 121 is removably inserted into a lower portion of the apparatus body 11. The feed tray 121 stores a sheet stack P1. The sheet stack P1 is a stack of a plurality of sheets P. The pickup roller 122 picks up the topmost sheet of the sheet stack P1 stored in the feed tray 121, one sheet at a time. The feed roller pair 123 feeds the sheet P picked up by the pickup roller 122 to the sheet transport path 111.

The paper feeder 12 includes a manual feeder. The manual feeder is attached to a left side surface of the apparatus body 11. The manual feeder includes a manual feed tray 124, a pickup roller 125, and a feed roller pair 126. The manual feed tray 124 is used to place a sheet P which is manually loaded. When a sheet P is manually loaded, the manual feed tray 124 is opened from the side surface of the apparatus body 11 as shown in FIG. 1. The pickup roller 125 picks up the sheet P placed on the manual feed tray 124. The feed roller pair 126 feeds the sheet P picked up by the pickup roller 125 to the sheet transport path 111.

The image forming section 13 includes a plurality of image forming units. Each of the image forming units forms a toner image which is to be transferred to the sheet P. These different image forming units form toner images of different colors. In this embodiment, a magenta image forming unit 13M, a cyan image forming unit 13C, a yellow image forming unit 13Y, and a black image forming unit 13Bk are provided as the image forming units. The unit 13M uses a magenta (hereinafter also referred to as "M") developer. The unit 13C uses a cyan (hereinafter also referred to as "C") developer. The unit 13Y uses a yellow (hereinafter also referred to as "Y") developer. The unit 13Bk uses a black (hereinafter also referred to as "Bk") developer.

The units 13M, 13C, 13Y, and 13Bk are sequentially arranged along a rotational direction of an intermediate transfer belt 141 described below from upstream to downstream (from left to right in FIG. 1). The units 13M, 13C, 13Y, and 13Bk each include a photosensitive drum 20 (image bearing member), a charging device 21, a developing device 23, and a cleaning device 25. The charging device 21, the developing device 23, and the cleaning device 25 are arranged around the photosensitive drum 20. Also, an exposing device 22 is provided below the units 13M, 13C, 13Y, and 13Bk. The single exposing device 22 is used for all of the units 13M, 13C, 13Y, and 13Bk.

The photosensitive drums 20 are driven to rotate about their own axes. The different photosensitive drums 20 bear different color toner images on circumferential surfaces thereof, specifically as follows.

An electrostatic latent image and a toner image which correspond to the M color are formed on a circumferential surface of the photosensitive drum 20 of the unit 13M. An electrostatic latent image and a toner image which correspond to the C color are formed on a circumferential surface of the photosensitive drum 20 of the unit 13C. An electrostatic latent image and a toner image which correspond to the Y color are formed on a circumferential surface of the photosensitive drum 20 of the unit 13Y. An electrostatic latent image and a toner image which correspond to the Bk color are formed on a circumferential surface of the photosensitive drum 20 of the unit 13Bk. The photosensitive drum 20 may be formed of, for example, amorphous silicon (a-Si)-based material.

The charging device 21 uniformly charges the surface of the photosensitive drum 20. The charging device 21 includes a charging roller and a charge cleaning brush. The charge cleaning brush removes toner adhering to the charging roller. The exposing device 22 includes several optical elements, such as a light source, a polygon mirror, a reflecting mirror, a deflecting mirror, etc. The exposing device 22 irradiates the uniformly charged circumferential surface of the photosensitive drum 20 with light which is modulated based on image data, to form an electrostatic latent image.

The developing device 23 supplies toner to the circumferential surface of the photosensitive drum 20 to develop the electrostatic latent image formed on the photosensitive drum 20. The developing device 23 uses a two-component developer. The two-component developer contains toner and carrier. The developing device 23 includes two mixing rollers 23A, a magnetic roller 23B, and a development roller 23C. The mixing rollers 23A transport the two-component developer in a circulating manner while mixing the two-component developer, thereby charging toner. A layer of the two-component developer is deposited on a circumferential surface of the magnetic roller 23B. A layer of the toner is deposited on a circumferential surface of the development roller 23C. The toner layer is formed by transferring toner from the magnetic roller 23B to the development roller 23C due to a potential difference between the magnetic roller 23B and the development roller 23C. The toner on the development roller 23C is supplied to the circumferential surface of the photosensitive drum 20. As a result, the electrostatic latent image is developed, thereby forming a toner image. The cleaning device 25 cleans the circumferential surface of the photosensitive drum 20 after the toner image is transferred.

The intermediate transfer unit 14 is provided in a space between the image forming section 13 and the toner replenisher 15. The intermediate transfer unit 14 includes four primary transfer rollers 24 (transfer members) and an intermediate transfer belt 141. The four primary transfer rollers 24 are arranged, corresponding to the units 13M, 13C, 13Y, and 13Bk.

Each of the primary transfer rollers 24 is pressed against the corresponding photosensitive drum 20 with the intermediate transfer belt 141 being interposed therebetween, whereby the toner image is transferred from the photosensitive drum 20 to the intermediate transfer belt 141, specifically as follows.

The primary transfer roller 24 is pressed against the photosensitive drum 20 with the intermediate transfer belt 141 being interposed therebetween, whereby a primary transfer nip portion (transfer nip) is formed between the primary transfer roller 24 and the photosensitive drum 20. The primary transfer roller 24 transfers the toner image on the photosensitive drum 20 to the intermediate transfer belt 141 (primary transfer). The intermediate transfer belt 141 is included in the intermediate transfer unit 14. The intermediate transfer belt 141 is opposed to all of the photosensitive drums 20.

The intermediate transfer belt 141 causes the different color toner images on the photosensitive drums 20 to be transferred thereto and superimposed together thereon. The intermediate transfer belt 141 causes the different color toner images formed on the photosensitive drums 20 to be superimposed together, carries the superimposed toner images, and transfers the superimposed toner images simultaneously to the sheet P. The intermediate transfer belt 141 is an endless belt loop which can rotate. The intermediate transfer belt 141 is wound between a drive roller 142 and a driven roller 143, which are described below, with a circumferential surface thereof being in contact with the circumferential surfaces of the photosensitive drums 20.

A secondary transfer roller 145 (sheet transfer member) is provided outside the intermediate transfer belt 141, facing the drive roller 142. The secondary transfer roller 145 transfers, from the intermediate transfer belt 141 to the sheet P, the different color toner images superimposed together on the intermediate transfer belt 141 (a first state described below) or a single-color toner image formed on the intermediate transfer belt 141 (a second state described below), specifically as follows.

The secondary transfer roller 145 is pressed against a circumferential surface of the intermediate transfer belt 141, whereby a secondary transfer nip portion is formed between the secondary transfer roller 145 and the drive roller 142. The toner image transferred (primary transfer) to the intermediate transfer belt 141 is transferred (secondary transfer) to the sheet P supplied from the paper feeder 12 at the secondary transfer nip portion.

The toner replenisher 15 stores toner used for image formation. In this embodiment, the toner replenisher 15 includes a magenta toner container 15M, a cyan toner container 15C, a yellow toner container 15Y, and a black toner container 15Bk. The toner containers 15M, 15C, 15Y, and 15Bk store M color replenishment toner, C color replenishment toner, Y color replenishment toner, and Bk color replenishment toner.

New M color toner is supplied from a toner outlet 15H formed in a bottom surface of the toner container 15M through a toner transport section (not shown) to the developing device 23 of the image forming unit 13M corresponding to the M color. New C color toner is supplied from a toner outlet 15H formed in a bottom surface of the toner container 15C through a toner transport section (not shown) to the developing device 23 of the image forming unit 13C corresponding to the C color. New Y color toner is supplied from a toner outlet 15H formed in a bottom surface of the toner container 15Y through a toner transport section (not shown) to the developing device 23 of the image forming unit 13Y corresponding to the Y color. New Bk color toner is supplied from a toner outlet 15H formed in a bottom surface of the toner container 15Bk through a toner transport section (not shown) to the developing device 23 of the image forming unit 13Bk corresponding to the Bk color.

The fixing section 16 includes a heat roller 161, a fixing roller 162, a fixing belt 163, and a pressure roller 164. The heat roller 161 includes a heat source therein. The fixing roller 162 is opposed to the heat roller 161. The fixing belt 163 is wound between the fixing roller 162 and the heat roller 161 with tension being exerted on the fixing belt 163. The pressure roller 164 is opposed to the fixing roller 162 across the fixing belt 163. The pressure roller 164 and the fixing roller 162 form a fixing nip portion. The sheet P supplied to the fixing section 16 is heated and pressed while passing through the fixing nip portion. As a result, the toner image, which has been transferred to the sheet P in the secondary transfer nip portion, is fixed to the sheet P.

The paper output section 17 includes an output tray 171. The output tray 171 is formed at a top portion of the apparatus body 11. The output tray 171 has a hollow portion. The output tray 171 receives the output sheet P at the hollow portion. The sheet P with the fixed toner image is output to the output tray 171 via the sheet transport path 111 extending from an upper portion of the fixing section 16.

Figure 4:
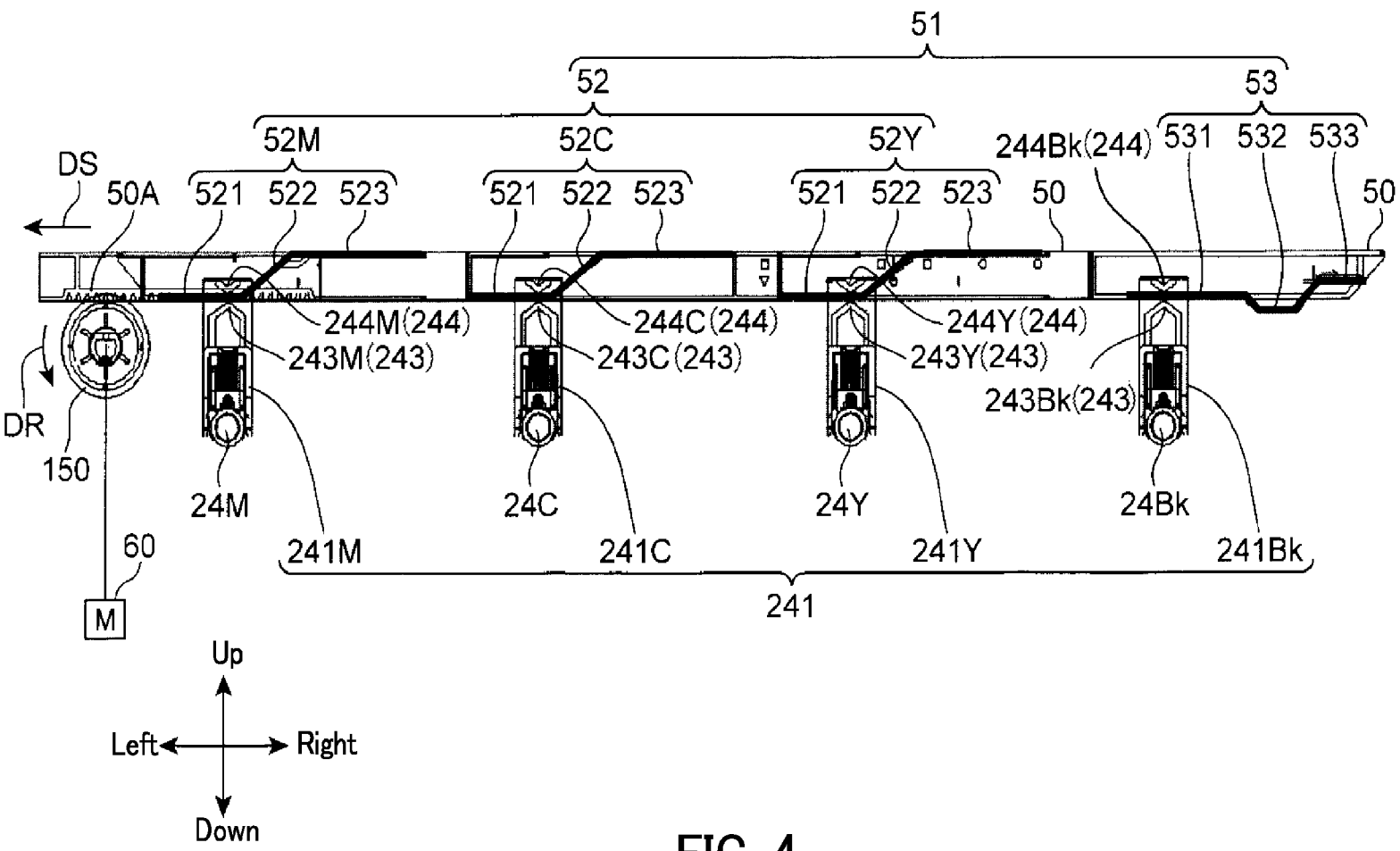
FIG. 4 is a cross-sectional view showing a portion of the intermediate transfer unit of the embodiment of the present disclosure.
Figure 5:
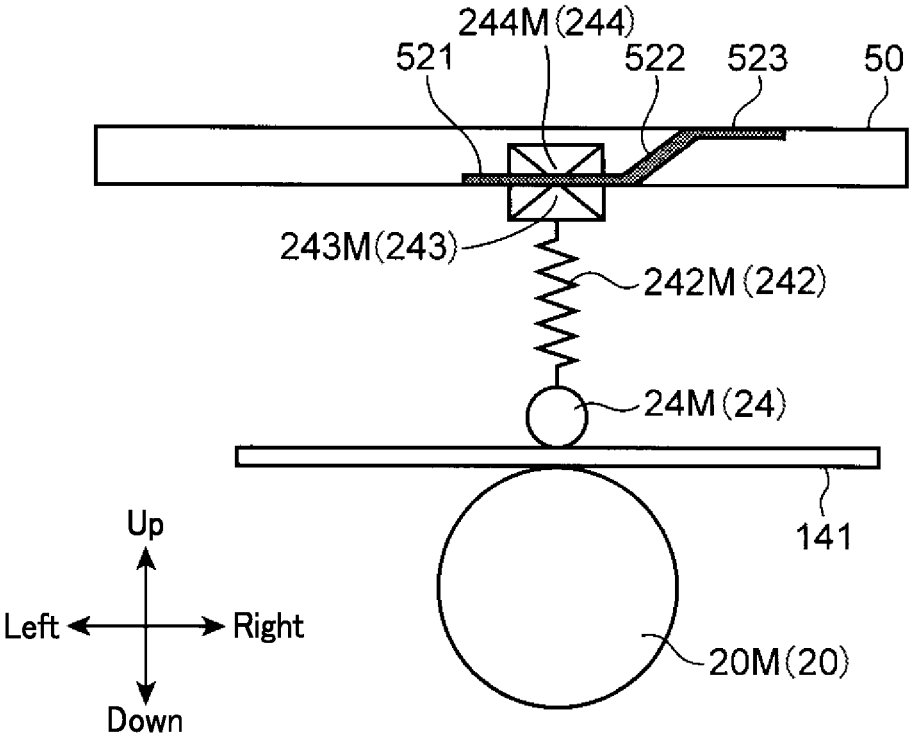
FIG. 5 is an enlarged cross-sectional view of a portion of FIG. 4.

Next, the intermediate transfer unit 14 (transfer device) of this embodiment will be described in detail with reference to FIGS. 4 and 5 in addition to FIGS. 1-3. FIG. 4 is a cross-sectional view showing a portion of the intermediate transfer unit 14 of this embodiment. FIG. 5 is an enlarged cross-sectional view of a portion of FIG. 4. Note that FIG. 5 shows the photosensitive drum 20M corresponding to the M color as the photosensitive drum 20.

The intermediate transfer unit 14 includes, in addition to the primary transfer rollers 24 and the intermediate transfer belt 141, a unit housing 14A (housing), a drive roller 142, a driven roller 143 (tension roller), roller housings 241, roller springs 242, a backup roller 146, a backup roller 147, and a belt cleaning device 144.

Referring to FIG. 2, the unit housing 14A is an outer housing for the intermediate transfer unit 14. The unit housing 14A has a box shape extending in a horizontal direction. The rollers (the primary transfer rollers 24, the drive roller 142, the driven roller 143, the backup roller 146, and the backup roller 147) are rotatably supported by the unit housing 14A. The intermediate transfer belt 141 is rotatably supported by the unit housing 14A via the rollers.

Referring to FIG. 3, the intermediate transfer belt 141 is wrapped around the drive roller 142 at an end in the longitudinal direction of the unit housing 14A.

A drive means (not shown) is linked to the drive roller 142. When the drive roller 142 is driven and rotated by the drive means, frictional force between the drive roller 142 and the intermediate transfer belt 141 drives the intermediate transfer belt 141 to rotate in a direction indicated by an arrow D3 in FIG. 3. A roll cleaner 200 is provided for the drive roller 142. The roll cleaner 200 cleans a circumferential surface of the drive roller 142.

The intermediate transfer belt 141 is wrapped around the driven roller 143 on the opposite side from the drive roller 142. The driven roller 143 has a function of exerting tension on the intermediate transfer belt 141. As described below, the tension is adjusted, depending on the different modes (first, second, and third states) of the image forming apparatus 10. The belt cleaning device 144 is provided in the vicinity of the driven roller 143. The belt cleaning device 144 removes residual toner from the circumferential surface of the intermediate transfer belt 141 (FIGS. 1 and 2).

The primary transfer rollers 24 (transfer members) are provided between the drive roller 142 and the driven roller 143 with a space between each roller. In FIG. 2, the primary transfer rollers 24 corresponding to the M, C, Y, and Bk colors are provided at a magenta transfer position TM, a cyan transfer position TC, a yellow transfer position TY, and a black transfer position TBk.

Specifically, referring to FIG. 3, a magenta primary transfer roller 24M, a cyan primary transfer roller 24C, a yellow primary transfer roller 24Y (these three rollers are second transfer members), and a black primary transfer roller 24Bk (first transfer member) are provided as the primary transfer rollers 24. Note that the black primary transfer roller 24Bk is the most downstream roller in the rotational direction of the intermediate transfer belt 141.

The primary transfer roller 24M is opposed to the M color photosensitive drum 20. The primary transfer roller 24C is opposed to the C color photosensitive drum 20. The primary transfer roller 24Y is opposed to the Y color photosensitive drum 20. The primary transfer roller 24Bk is opposed to the Bk color photosensitive drum 20.

The respective roller springs 242 described below apply a downward force to the corresponding primary transfer rollers 24. As a result, the primary transfer rollers 24 are pressed against the photosensitive drums 20 with the intermediate transfer belt 141 being interposed therebetween.

The roller housings 241 (support members) are provided in the unit housing 14A and are a box-shaped member. As the roller housings 241, a pair of roller housings 241M (second support member) corresponding to the M color, a pair of roller housings 241C (second support member) corresponding to the C color, a pair of roller housings 241Y (second support member) corresponding to the Y color, and a pair of roller housings 241Bk (first support member) corresponding to the Bk color, are provided.

As shown in FIGS. 3 and 4, the pair of roller housings 241M are provided at opposite end portions of the intermediate transfer belt 141 in a width direction (a direction (i.e., the front-back direction) intersecting a rotational direction (indicated by the arrow D3) of the intermediate transfer belt 141). The pair of roller housings 241C are provided at opposite end portions in the width direction of the intermediate transfer belt 141. The pair of roller housings 241Y are provided at opposite end portions in the width direction of the intermediate transfer belt 141. The pair of roller housings 241Bk are provided at opposite end portions in the width direction of the intermediate transfer belt 141.

The primary transfer roller 24M of the M color is rotatably supported by the pair of roller housings 241M. The primary transfer roller 24C of the C color is rotatably supported by the pair of roller housings 241C. The primary transfer roller 24Y of the Y color is rotatably supported by the pair of roller housings 241Y. The primary transfer roller 24Bk of the Bk color is rotatably supported by the pair of roller housings 241Bk.

The roller housing 241 is caused to slide relative to the unit housing 14A so that the pressing force of the primary transfer roller 24 on the photosensitive drum 20 is varied, specifically as follows.

The roller housing 241 is caused to slide in the up-down direction. The slide of the roller housing 241 changes the pressing force of the primary transfer roller 24 on the photosensitive drum 20. The roller housing 241 includes a pair of lower support portions 243 (first support portion) and a pair of upper support portions 244 (second support portion) (FIG. 4). As the lower support portions 243, a pair of lower support portions 243M, a pair of lower support portions 243C, a pair of lower support portions 243Y, and a pair of lower support portions 243Bk, are provided. As the upper support portions 244, a pair of upper support portions 244M, a pair of upper support portions 244C, a pair of upper support portions 244Y, and a pair of upper support portions 244Bk, are provided.

The upper support portion 244, which is a substantially triangular member, protrudes downward at an upper end portion of the roller housing 241. The upper support portion 244 is opposed to the lower support portion 243. Specifically, the lower support portion 243 is located below the upper support portion 244 with a predetermined gap between the lower support portion 243 and a vertex portion of the upper support portion 244. The lower support portion 243, which is a substantially triangular member, protrudes upward.

As color guides 52 described below, a color guide 52M, a color guide 52C, and a color guide 52Y are provided. A black guide 53 is provided.

The color guide 52M is inserted between the lower support portion 243M and the upper support portion 244M. The color guide 52C is inserted between the lower support portion 243C and the upper support portion 244C. The color guide 52Y is inserted between the lower support portion 243Y and the upper support portion 244Y. The black guide 53 is inserted between the lower support portion 243Bk and the upper support portion 244Bk. The color guides 52M-52Y cause the roller housings 241M-241Y to move vertically. The black guide 53 causes the roller housing 241Bk to move vertically.

The roller spring 242 (FIG. 3), which is a spring member, is provided in the roller housing 241 to apply a downward force to the primary transfer roller 24. As the roller springs 242, a roller spring 242M, a roller spring 242C, a roller spring 242Y, and a roller spring 242Bk are provided.

The backup roller 146 and the backup roller 147 are arranged to interpose the primary transfer rollers 24. Specifically, the backup roller 147 is provided upstream of the magenta primary transfer roller 24M in the rotational direction of the intermediate transfer belt 141. The backup roller 146 is provided downstream of the black primary transfer roller 24Bk in the rotational direction of the intermediate transfer belt 141.

The backup roller 146 and the backup roller 147 apply a force in a direction from the inside to the outside of the intermediate transfer belt 141. As a result, a primary transfer region ranging from the magenta primary transfer roller 24M to the black primary transfer roller 24Bk is formed in a linear manner. Note that when a single-color toner image is formed on the intermediate transfer belt 141 by the black photosensitive drum 20, or when the image forming apparatus 10 is not in use, the backup roller 147 is moved further inside the intermediate transfer belt 141. In other words, in this case, the intermediate transfer belt 141 is wound between the backup roller 146 or the black primary transfer roller 24Bk and the driven roller 143 with tension being exerted to the intermediate transfer belt 141.

The intermediate transfer unit 14 further includes a pair of sliders 50 (moving member), a pair of pinions 150, a pair of tension springs 151 (force applying member), and a pair of motors 60. The tension spring 151 is an example spring.

The pair of sliders 50 are provided at an upper surface portion of the unit housing 14A at opposite ends in the front-back direction of the intermediate transfer belt 141. The slider 50, which is a plate-like member, extends in the left-right direction between the drive roller 142 and the driven roller 143. The slider 50 is caused to move relative to the unit housing 14A. Specifically, the slider 50 is caused to move in the unit housing 14A in the left-right direction.

As described below, the sliding movement of the slider 50 is converted into a change in the pressing force of the primary transfer roller 24 on the photosensitive drum 20. The slider 50 includes a rack 50A. The rack 50A is provided at a lower left end portion of the slider 50. The rack 50A includes a plurality of gear teeth spaced in the left-right direction. The rack 50A is engaged with the pinion 150.

The pinion 150 is rotatably supported by the unit housing 14A between the driven roller 143 and the backup roller 147. As shown in FIG. 3, the pair of pinions 150 are arranged in the front-back direction. Gear teeth provided on an outer circumferential portion of the pinion 150 are engaged with the gear teeth of the rack 50A. The pinion 150 is driven by the motor 60 (FIG. 4) to rotate. When the pinion 150 is rotated by the motor 60, the slider 50 is slid in the left-right direction via the rack 50A.

The intermediate transfer unit 14 further includes a switch section 51 (FIG. 4). The switch section 51 is provided in the slider 50. In a first state, the switch section 51 causes all of the primary transfer rollers 24 to be pressed against all of the photosensitive drums 20. In other words, in the first state, the switch section 51 causes the primary transfer rollers 24 of the different colors to be pressed against the respective corresponding color photosensitive drums 20.

Thus, the first state is the state in which toner images of a plurality of colors (different colors) are transferred from the photosensitive drums 20 corresponding to the respective colors to the intermediate transfer belt 141 and superimposed together.

Here, the photosensitive drum 20 of the unit 13M, the photosensitive drum 20 of the unit 13C, the photosensitive drum 20 of the unit 13Y, and the photosensitive drum 20 of the unit 13Bk are referred to as a photosensitive drum 20M, a photosensitive drum 20C, a photosensitive drum 20Y, and a photosensitive drum 20Bk, respectively.

In a second state, the switch section 51 causes the primary transfer roller 24Bk of the black color to be pressed against the photosensitive drum 20Bk (first image bearing member) of the black color. Note that the primary transfer roller 24Bk is opposed to the photosensitive drum 20Bk of the photosensitive drums 20. In the second state, the switch section 51 also separates the primary transfer rollers 24M, 24C, and 24Y of the other colors from the photosensitive drums 20M, 20C, and 20Y (all are second image bearing members), respectively, of the other colors. Note that the primary transfer rollers 24M, 24C, and 24Y are opposed to the photosensitive drums 20M, 20C, and 20Y, respectively, other than the photosensitive drum 20Bk of the photosensitive drums 20.

Thus, the second state is the state in which a single-color toner image, i.e., a black toner image, is transferred from the photosensitive drum 20Bk corresponding to the black color of the photosensitive drums 20 corresponding to a plurality of colors, to the intermediate transfer belt 141.

In a third state, the switch section 51 separates a plurality (all) of the primary transfer rollers 24 from a plurality (all) of the photosensitive drums 20.

Thus, the third state is the state in which no color toner images are transferred from the photosensitive drums 20 to the intermediate transfer belt 141.

The switch section 51 includes color guides 52 (second guide members) and a black guide 53 (first guide member). The color guides 52 and the black guide 53 each serve as a guide member. As the color guides 52, three color guides, i.e., color guides 52M, 52C, and 52Y, are provided, corresponding to magenta, cyan, and yellow. The color guides 52 and the black guide 53 are a plate-like member which has a predetermined width in the front-back direction and extends in the left-right direction.

The three color guides 52 and the black guide 53 are engaged with the respective color corresponding roller housings 241. The three color guides 52 and the black guide 53 each have a function of moving the color corresponding roller housing 241 in the up-down direction. To do so, the color guides 52 and the black guide 53 are each bent by predetermined angles at a plurality of portions. The three color guides 52 and the black guide 53 are each inserted between the lower and upper support portions 243 and 244 of the color corresponding roller housing 241.

The color guide 52 includes a first-first guide portion 521 (first guide portion), a link portion 522, and a second-first guide portion 523 (second guide portion). The first-first guide portion 521 is provided at a left end portion of the color guide 52, extending in the left-right direction. The first-first guide portion 521 causes the roller housing 241 to be located at a first position. The first position is where the roller housing 241 is opposed to the photosensitive drum 20.

The link portion 522 is provided contiguous to a right end portion of the first-first guide portion 521, extending rightward and upward. The second-first guide portion 523 is provided contiguous to a right end portion of the link portion 522, extending in the left-right direction. The second-first guide portion 523 is located higher than the first-first guide portion 521. The second-first guide portion 523 causes the roller housing 241 to be located at a second position. The second position is where the roller housing 241 is further separated from the photosensitive drum 20 than when it is located at the first position.

The black guide 53 (first guide member) includes a first-second guide portion 531 (first guide portion), a second-second guide portion 532 (third guide portion), and a third-second guide portion 533 (second guide portion). The black guide 53 functions as a pressing force adjuster. The first-second guide portion 531 has a function similar to that of the first-first guide portion 521 of the color guide 52. The third-second guide portion 533 has a function similar to that of the second-first guide portion 523 of the color guide 52. The second-second guide portion 532 is provided between the first-second guide portion 531 and the third-second guide portion 533.

The black guide 53 also has a function of changing a pressing force of the primary transfer roller 24Bk of the black color on the photosensitive drum 20Bk between the first and second states. Specifically, the black guide 53 sets the pressing force of the primary transfer roller 24Bk to be higher in the second state than in the first state.

The first-second guide portion 531 is provided at a left end portion of the black guide 53, extending in the left-right direction. The first-second guide portion 531 causes the roller housing 241Bk of the black color to be located at a first position. The first position is where the roller housing 241Bk is opposed to the photosensitive drum 20Bk. The third-second guide portion 533 is located at a right end portion of the black guide 53, extending in the left-right direction. The third-second guide portion 533 is located higher than the first-second guide portion 531. The third-second guide portion 533 causes the roller housing 241Bk of the black color to be located at a second position. The second position is where the roller housing 241Bk is further separated from the photosensitive drum 20 than when it is located at the first position.

The second-second guide portion 532 is provided between the first-second guide portion 531 and the third-second guide portion 533, extending in the left-right direction. The second-second guide portion 532 causes the roller housing 241Bk of the black color to be located at a third position. The third position is where the roller housing 241Bk is located closer to the photosensitive drum 20Bk than when it is located at the first position.

Note that the black guide 53 is engaged with the roller housing 241Bk. The roller housing 241Bk supports the primary transfer roller 24Bk. The color guide 52M is engaged with the roller housing 241M. The roller housing 241M supports the primary transfer roller 24M. The color guide 52C is engaged with the roller housing 241C. The roller housing 241C supports the primary transfer roller 24C. The color guide 52Y is engaged with the roller housing 241Y. The roller housing 241Y supports the primary transfer roller 24Y.

The slider 50 supports the three color guides 52 and the black guide 53. In the first state, the slider 50 causes the first-first guide portions 521 of the three color guides 52 and the first-second guide portion 531 of the black guide 53 to engage with the respective color corresponding roller housings 241. In the second state, the slider 50 causes the second-first guide portions 523 of the three color guides 52 to engage with the respective color corresponding roller housings 241, and causes the second-second guide portion 532 of the black guide 53 to engage with the roller housing 241Bk.

Next, arrangements of the primary transfer rollers 24 in the image formation states of the intermediate transfer unit 14 will be described with reference to FIGS. 4 and 5. A state shown in FIG. 4 corresponds to the first state. The first state is the state in which a plurality of different color toner images are transferred from the respective corresponding color photosensitive drums 20 to the intermediate transfer belt 141 and superimposed together. In this case, the pinion 150 is engaged with a left end portion of the rack 50A.

The roller housing 241M of the magenta color, the roller housing 241C of the cyan color, and the roller housing 241Y of the yellow color are engaged with the first-first guide portions 521 of the color guides 52M, 52C, and 52Y, respectively, which are opposed thereto. The roller housing 241Bk of the black color is engaged with the first-second guide portion 531 of the black guide 53. As a result, the roller housing 241 of each color is located at the first position.

Thereafter, the roller spring 242 (see FIGS. 3 and 5) provided in the roller housing 241 applies a downward force to the primary transfer roller 24. As a result, the primary transfer roller 24 of each color is pressed against the photosensitive drum 20 with the intermediate transfer belt 141 being interposed therebetween. At this time, the pressing force of the primary transfer roller 24Bk of the black color in the first state which is applied to the photosensitive drum 20Bk is set to be lower than that in the second state. As a result, the following problem may be prevented: in the first state, if the pressing force of the primary transfer roller 24Bk is excessively high, slip occurs between the drive roller 142 and the intermediate transfer belt 141, resulting in color misalignment on the intermediate transfer belt 141.

In the first state of FIG. 4, if the pinion 150 is rotated by the motor 60 in a direction indicated by an arrow DR, the slider 50 is moved leftward (a direction indicated by an arrow DS) due to the engagement of the pinion 150 with the rack 50A. As a result, the state of the intermediate transfer unit 14 is transitioned to the second state. The second state is the state in which a single-color toner image, i.e., a black toner image, is transferred from the photosensitive drum 20Bk to the intermediate transfer belt 141.

The roller housing 241M of the magenta color, the roller housing 241C of the cyan color, and the roller housing 241Y of the yellow color pass through the link portions 522 of the color guides 52M, 52C, and 52Y, respectively, which are opposed thereto, and are then engaged with the respective second-first guide portions 523 after. The roller housing 241Bk of the black color is engaged with the second-second guide portion 532 of the black guide 53.

As a result, the roller housing 241M of the magenta color, the roller housing 241C of the cyan color, and the roller housing 241Y of the yellow color are located at the second position. At the second position, the roller springs 242 have the natural length, and the primary transfer rollers 24 of the three colors are separated from the respective corresponding photosensitive drums 20. As a result, the contact between the photosensitive drums 20 and the intermediate transfer belt 141 is removed at the primary transfer nip portions for the magenta, cyan, and yellow colors.

Further, the roller housing 241Bk of the black color is provided at the third position. As a result, the primary transfer roller 24Bk of the black color is pressed against the photosensitive drum 20 by a higher pressing force than that of the first state.

In the second state, if the primary transfer rollers 24 of the colors other than the black color are separated from the photosensitive drums 20, the stability of rotation of the intermediate transfer belt 141 is likely to decrease. Therefore, slip is typically likely to occur between the photosensitive drum 20Bk of the black color and the intermediate transfer belt 141.

However, in this embodiment, the pressing force of the primary transfer roller 24Bk of the black color is set to be higher in the second state than in the first state. As a result, in the second state, the performance of transferring a single-color toner image, i.e., a black toner image, is suitably ensured, and the occurrence of banding (color band) etc. in a toner image is reduced or prevented.

In the second state, when the pinion 150 is rotated in the direction indicated by the arrow DR, the slider 50 is further moved leftward. As a result, the engagement of the roller housing 241M of the magenta color, the roller housing 241C of the cyan color, and the roller housing 241Y of the yellow color with the first-second guide portions 523 of the color guides 52M, 52C, and 52Y, which are opposed thereto, is maintained.

On the other hand, the roller housing 241Bk of the black color is engaged with the third-second guide portion 533 of the black guide 53. As a result, the primary transfer roller 24Bk of the black color is located at the second position, as are the primary transfer rollers 24 of the other colors. Thus, the primary transfer rollers 24 of all the colors are separated from the photosensitive drums 20, which are opposed thereto (third state).

When all the primary transfer rollers 24 are separated from the photosensitive drums 20, the photosensitive drums 20 and the intermediate transfer belt 141 can be loaded into and removed from the apparatus body 11. At this time, the photosensitive drums 20 and the intermediate transfer belt 141 may be prevented from rubbing against each other. During transportation of the image forming apparatus 10, the tension of the intermediate transfer belt 141 is maintained low by keeping the intermediate transfer unit 14 in the third state. As a result, portions of the intermediate transfer belt 141 wrapped around the rollers may be prevented from being semi-permanently curled.

Figure 6:
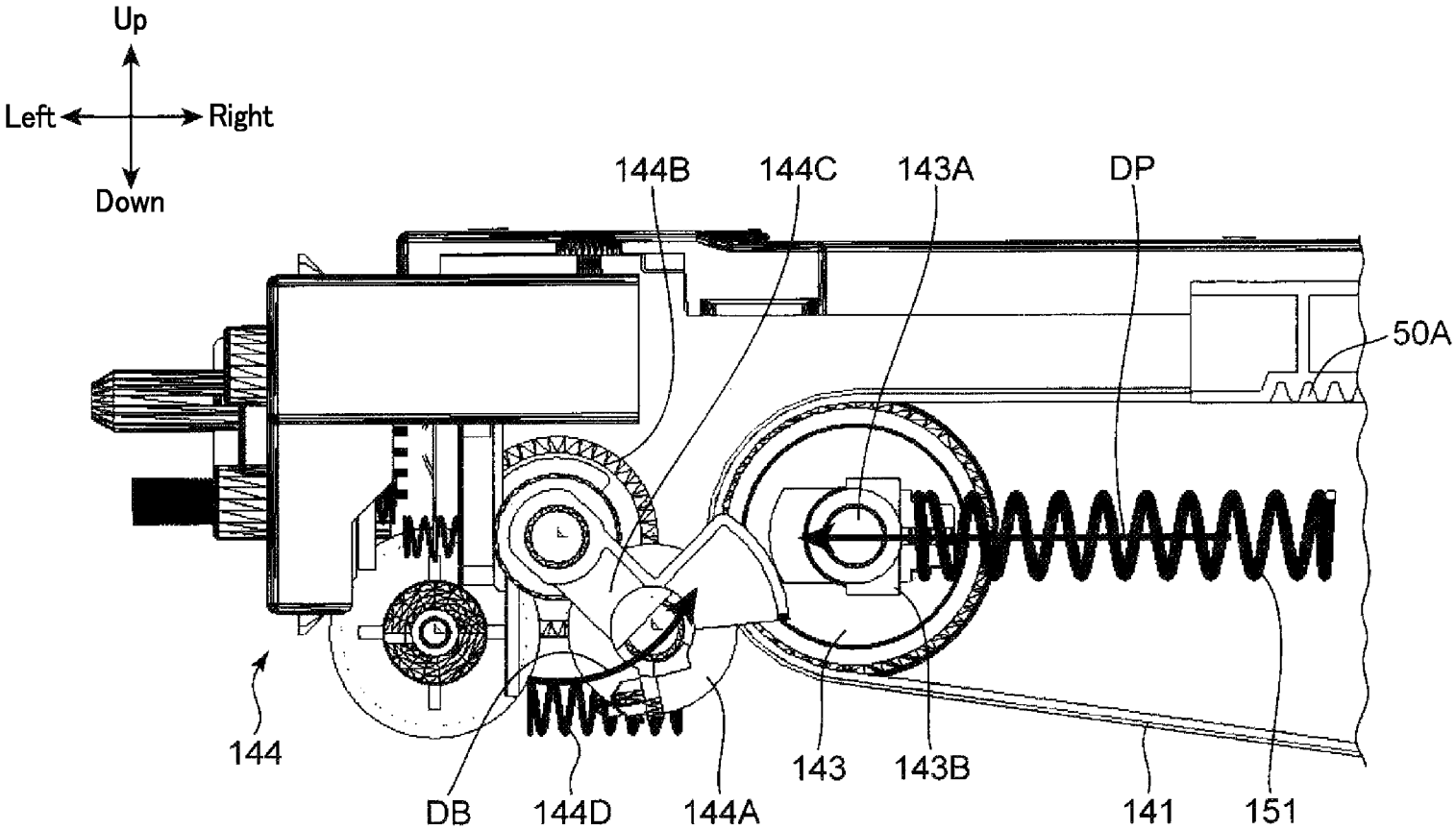
FIG. 6 is an enlarged cross-sectional view of a portion of the intermediate transfer unit of the embodiment of the present disclosure.
Figure 7:
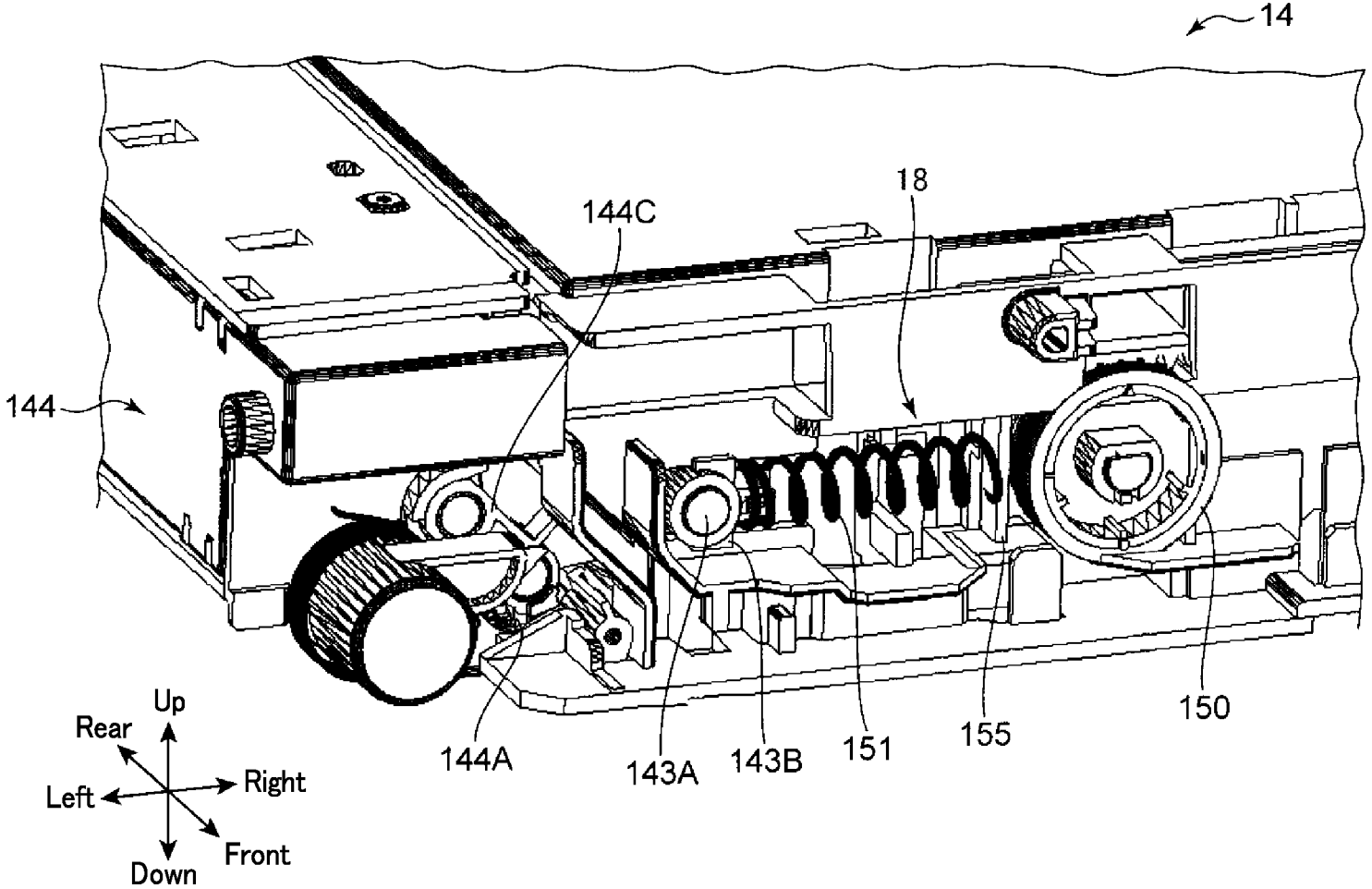
FIG. 7 is an enlarged perspective view of a portion of the intermediate transfer unit of the embodiment of the present disclosure.
Figure 8:
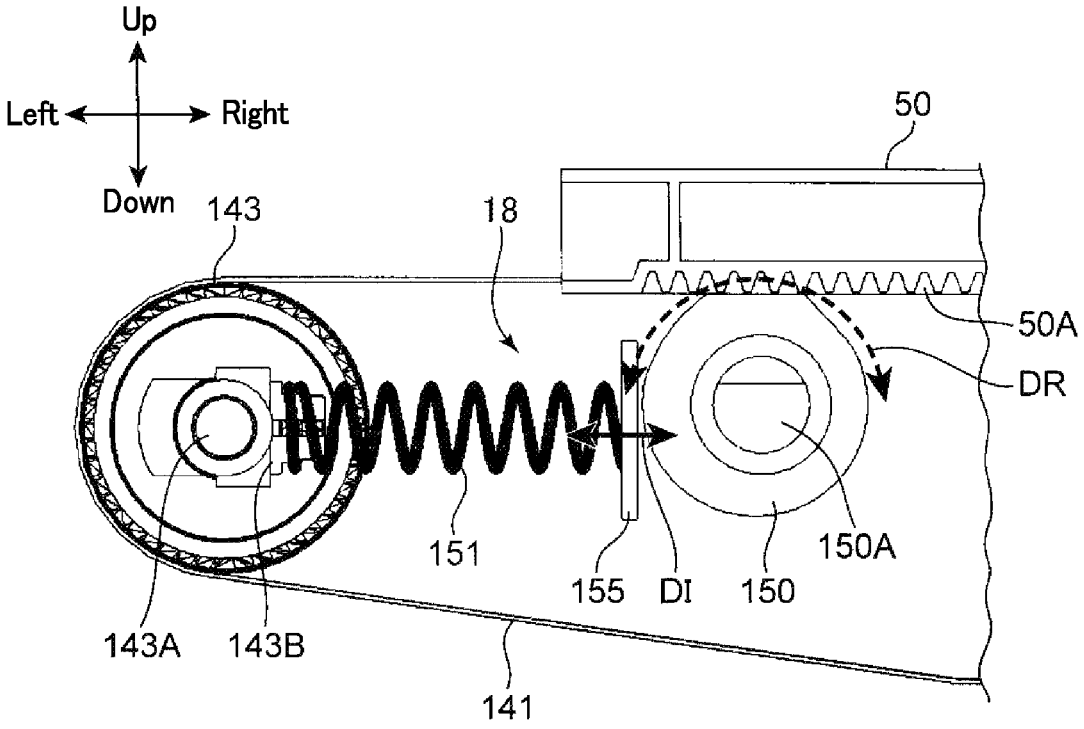
FIG. 8 is a cross-sectional view showing an arrangement in which a driven roller is pressed according to the embodiment of the present disclosure.
Figures 9A, 9B, 9C:
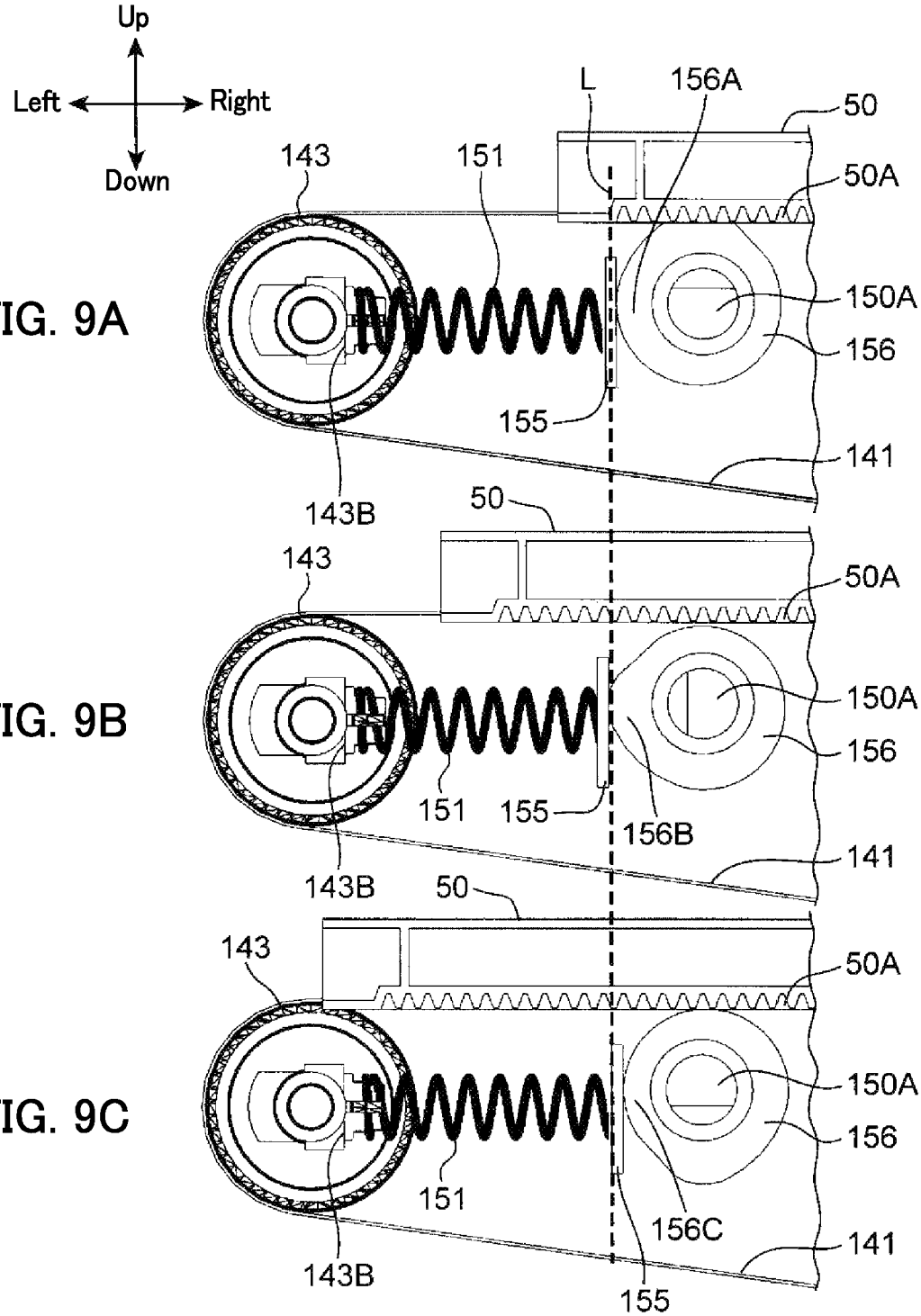
FIG. 9A is a cross-sectional view showing a state in which the driven roller is pressed in the intermediate transfer unit of the embodiment of the present disclosure (corresponding to a first state).
FIG. 9B is a cross-sectional view showing a state in which the driven roller is pressed in the intermediate transfer unit of the embodiment of the present disclosure (corresponding to a second state).
FIG. 9C is a cross-sectional view showing a state in which the driven roller is pressed in the intermediate transfer unit of the embodiment of the present disclosure (corresponding to a third state).

Next, it will be described how tension is exerted on the intermediate transfer belt 141 by the driven roller 143 of this embodiment. FIGS. 6 and 7 are enlarged cross-sectional view and perspective view, respectively, showing the driven roller 143 and its surroundings of the intermediate transfer unit 14 of this embodiment. FIG. 8 is a cross-sectional view showing an arrangement in which the driven roller 143 of this embodiment is pressed. FIGS. 9A, 9B, and 9C are cross-sectional views each showing a state in which the driven roller 143 is pressed in the intermediate transfer unit 14 of this embodiment.

Referring to FIG. 6, the driven roller 143 exerts leftward tension on the intermediate transfer belt 141. The driven roller 143 includes a driven roller shaft 143A and a pair of bearing members 143B. The driven roller shaft 143A is a rotating shaft of the driven roller 143. The pair of bearing members 143B support the driven roller shaft 143A at opposite end portions in the shaft direction of the driven roller 143. The tension which is exerted by the driven roller 143 on the intermediate transfer belt 141 is derived from the tension spring 151 (force applying member). The tension spring 151 applies a force to the driven roller 143 toward the inner circumferential surface of the intermediate transfer belt 141 (a direction indicated by an arrow DP). A left end portion of the tension spring 151 is fitted into a portion of the bearing member 143B which protrudes rightward.

On the other hand, a rightward pressing force is applied by the belt cleaning device 144 to the intermediate transfer belt 141. The belt cleaning device 144 includes a cleaning brush 144A, a cleaning roller 144B, an arm 144C, and a brush spring 144D.

The cleaning brush 144A is in contact with the intermediate transfer belt 141 while being rotated, to remove toner from the surface of the intermediate transfer belt 141. The cleaning roller 144B has a circumferential surface which is in contact with an outer circumferential surface of the cleaning brush 144A. The cleaning roller 144B collects toner from the cleaning brush 144A while being rotated. The arm 144C supports the cleaning brush 144A so that the cleaning brush 144A can swing about a shaft of the cleaning roller 144B as a pivot.

The brush spring 144D applies a force to a tip portion of the arm 144C toward the driven roller 143 (a direction indicated by an arrow DB). The force applied by the brush spring 144D causes the cleaning brush 144A to be pressed against the intermediate transfer belt 141 in the right direction. Therefore, in a region where the intermediate transfer belt 141 is wrapped around the driven roller 143, the tension exerted on the intermediate transfer belt 141 is generated by a difference between the force applied by the tension spring 151 and the force applied by the brush spring 144D.

In this embodiment, the tension spring 151 applies different forces to the driven roller 143 in the different states, i.e., the first, second, and third states. The intermediate transfer unit 14 includes an applied force adjuster 18 (FIGS. 7 and 8). The applied force adjuster 18 changes the force which is applied by the tension spring 151 to the driven roller 143. Specifically, the applied force adjuster 18 sets the force applied by the tension spring 151 to be greater in the second state than in the first state. The applied force adjuster 18 also sets the force applied by the tension spring 151 to be smaller in the third state than in the first state. The applied force adjuster 18 includes a force applying plate 155 and a cam 156 (FIGS. 9A-9C). The force applying plate 155 is in contact with the cam 156. The tension spring 151 is arranged between the bearing member 143B and the force applying plate 155.

The force applying plate 155, which is a plate-like member, is in contact with a right end portion of the tension spring 151. The force applying plate 155 is caused to slide in the left-right direction.

The cam 156 (FIGS. 9A-9C) is in contact with a right surface of the force applying plate 155. The cam 156 is rotatably supported by a pinion shaft 150A on the back side of the pinion 150. The pinion shaft 150A is a shaft of the pinion 150. The rotation of the cam 156 causes the force applying plate 155 to move along the longitudinal direction of the tension spring 151. In other words, the force applying plate 155 can be moved in the left-right direction as the cam 156 is rotated. Note that the cam 156 (FIGS. 9A-9C) has a first inner diameter portion 156A, a second inner diameter portion 156B, and a third inner diameter portion 156C.

Referring to FIG. 8, the pinion 150 is rotated in the direction indicated by the arrow DR, depending on the first, second, and third states. In this case, the cam 156 supported by the pinion shaft 150A is rotated in association with the pinion 150. As a result, the force applying plate 155 is moved in a direction indicated by an arrow DI.

FIG. 9A is a cross-sectional view showing an arrangement of the force applying plate 155 and the cam 156 in the first state. In the first state, the first inner diameter portion 156A of the cam 156 is in contact with the force applying plate 155. Specifically, when the pinion 150 is located at a left end portion of the rack 50A, the first inner diameter portion 156A of the cam 156 is opposed to the force applying plate 155. As a result, the force applying plate 155 is located on a reference line L of FIGS. 9A-9C. At this time, the tension spring 151 is compressed between the force applying plate 155 located on the reference line L and the bearing member 143B. As a result, a first applied force is applied to the driven roller 143 in the left direction.

The driven roller 143 exerts tension on the intermediate transfer belt 141 correspondingly to the first applied force. The intermediate transfer belt 141 is wound between the drive roller 142 and the driven roller 143 with the tension being exerted on the intermediate transfer belt 141. Accordingly, a plurality of color toner images can be formed and superimposed together on the intermediate transfer belt 141.

FIG. 9B is a cross-sectional view showing an arrangement of the force applying plate 155 and the cam 156 in the second state. In the second state, the second inner diameter portion 156B of the cam 156 is in contact with the force applying plate 155, so that the force applying plate 155 is closer to the bearing member 143B than in the first state. Specifically, when the pinion 150 is rotated and moved to a middle portion in the left-right direction of the rack 50A, the second inner diameter portion 156B of the cam 156 is opposed to the force applying plate 155. As a result, the force applying plate 155 is located to the left of the reference line L of FIGS. 9A-9C. At this time, the tension spring 151 is compressed between the force applying plate 155 located closer to the driven roller 143 than in the first state, and the bearing member 143B. As a result, a second applied force is applied to the driven roller 143 in the left direction.

The second applied force is set to be greater than the first applied force. Therefore, even when, in the second state, the primary transfer roller 24M of the magenta color, the primary transfer roller 24C of the cyan color, and the primary transfer roller 24Y of the yellow color are separated from the photosensitive drums 20, and therefore, the tension of the intermediate transfer belt 141 decreases, the tension exerted by the driven roller 143 increases, whereby the stability of rotation of the intermediate transfer belt 141 is suitably maintained. As a result, the performance of transferring a black color toner image to the intermediate transfer belt 141 is satisfactorily maintained. Also, the occurrence of slip between the intermediate transfer belt 141 and the drive roller 142 during transfer of a black color toner image to the intermediate transfer belt 141 is reduced or prevented, whereby the occurrence of banding in the toner image is reduced or prevented.

FIG. 9C is a cross-sectional view showing an arrangement of the force applying plate 155 and the cam 156 in the third state. In the third state, the third inner diameter portion 156C of the cam 156 is in contact with the force applying plate 155, so that the force applying plate 155 is further separated from the bearing member 143B than in the first state. Specifically, the pinion 150 is further rotated and moved to a right end portion of the rack 50A, so that the third inner diameter portion 156C of the cam 156 is opposed to the force applying plate 155. As a result, the force applying plate 155 is located to the right of the reference line L of FIGS. 9A-9C. At this time, the tension spring 151 is compressed between the force applying plate 155 further separated from the driven roller 143 than in the first state, and the bearing member 143B. As a result, a third applied force is applied to the driven roller 143 in the left direction.

The third applied force is set to be smaller than the first applied force. Therefore, in the third state, the primary transfer rollers 24 of all the colors are separated from the photosensitive drums 20, and therefore, not only the tension of the intermediate transfer belt 141 decreases, but also the tension exerted by the driven roller 143 decreases. As a result, excessive tension may be prevented from being exerted on the intermediate transfer belt 141. When the intermediate transfer unit 14 is in the third state, the exertion of excessive tension may be prevented. Therefore, the intermediate transfer belt 141 may be further prevented from being semi-permanently curled during a stand-by period in which image formation is not being performed and during transportation of the image forming apparatus 10.

Note that, in another embodiment, the force applying plate 155 may be located further from the driven roller 143 than in the first state so that the tension spring 151 has the natural length, and therefore, no or substantially no force is applied by the tension spring 151 to the driven roller 143.

The intermediate transfer unit 14 of the embodiment of the present disclosure and the image forming apparatus 10 including the intermediate transfer unit 14 have been described above. The present disclosure is not limited to this. Alternatively, for example, the following variations may be made.

(1) In the above embodiment, a single-color toner image of the black color is formed on the intermediate transfer belt 141. The present disclosure is not limited to this. A single-color toner image of another color may be formed on the intermediate transfer belt 141. The color of toner is also not limited to magenta, cyan, yellow, or black.

(2) The present disclosure provides a transfer device (the intermediate transfer unit 14). When the transfer device transfers a toner image to an intermediate transfer belt (the intermediate transfer belt 141) which is opposed to a plurality of image bearing members (the photosensitive drums 20), the occurrence of a defect in the toner image is reduced or prevented. The present disclosure also provides an image forming apparatus (the image forming apparatus 10) including such a transfer device.

(3) According to the present disclosure, in a first state in which a plurality of toner images of different colors are transferred from a plurality of image bearing members (the photosensitive drums 20) to an intermediate transfer belt (the intermediate transfer belt 141) and superimposed together, a plurality of transfer members (the primary transfer rollers 24) are pressed against the respective corresponding image bearing members. As a result, transfer nip portions (the primary transfer nip portions) corresponding to the respective colors are formed.

On the other hand, in a second state in which a single-color toner image is transferred from a first image bearing member (the photosensitive drum 20Bk) to the intermediate transfer belt, a first transfer member (the primary transfer roller 24Bk) opposed to the first image bearing member is pressed against the first image bearing member. Second transfer members (the primary transfer rollers 24M-24Y) opposed to second image bearing members (the photosensitive drums 20M-20Y) other than the first image bearing member are separated from the second image bearing members. As a result, when a toner image is transferred from the first image bearing member to the intermediate transfer belt, problems with the other transfer nip portions (primary transfer nip portions) are reduced or overcome. The problems are: unnecessary friction between the second image bearing members and the intermediate transfer belt; supply of a sufficient drive force for driving the second image bearing members; transfer of toner from the intermediate transfer belt to the second image bearing members; etc.

On the other hand, when the second transfer members are separated from the second image bearing members, tension exerted on the intermediate transfer belt and the performance of rotating the intermediate transfer belt may be altered. Even in such a case, the configuration of the present disclosure causes a pressing force adjuster (the black guide 53) to change the pressing force of the first transfer member to the first image bearing member, between the first and second states. Therefore, even if the performance of transferring a single-color toner image is varied due to changes in the tension exerted on the intermediate transfer belt and the performance of rotating the intermediate transfer belt, the transfer performance can be compensated for by adjustment of the pressing force. As a result, the occurrence of a defect in a single-color toner image is suitably reduced or prevented.

(4) When the second transfer members (the primary transfer rollers 24M-24Y) are separated from the second image bearing members (the photosensitive drums 20M-20Y), the stability of rotation of the intermediate transfer belt (the intermediate transfer belt 141) decreases, and therefore, slip is likely to occur between the first image bearing member (the photosensitive drum 20Bk) and the intermediate transfer belt. According to the present disclosure, the pressing force of the first transfer member (the primary transfer roller 24Bk) is set to be greater in the second state than in the first state. As a result, in the second state, the performance of transferring a single-color toner image is suitably ensured, and the occurrence of banding (color band) etc. in a toner image is reduced or prevented. Since the pressing force of the first transfer member is set to be smaller in the first state than in the second state, the occurrence of color misalignment on the intermediate transfer belt in the first state is reduced or prevented.

(5) According to the present disclosure, the first guide portions (the first-first guide portions 521 and the first-second guide portion 531) and the second guide portions (the second-first guide portions 523 and the third-second guide portion 533) of the guide members (the color guides 52 and the black guide 53) cause a plurality of support members (the roller housings 241) to move to the first and second positions. As a result, the transfer members (the primary transfer rollers 24) are located close to or away from the image bearing members (the photosensitive drums 20). Of the guide members, the first guide member (the black guide 53) corresponding to the first transfer member (the primary transfer roller 24Bk) also serves as a pressing force adjuster. The first guide member includes the third guide portion (the second-second guide portion 532) between the first guide portion (the first-second guide portion 531) and the second guide portion (the third-second guide portion 533). The third guide portion causes the first support member (the roller housing 241Bk) to be located at the third position which is closer to the image bearing member than the first position.

(6) According to the present disclosure, a moving member (the sliders 50) supports a plurality of guide members (the color guides 52 and the black guide 53). In the first state, as the moving member is moved relative to the housing (the unit housing 14A), the first guide portions (the first-first guide portions 521 and the first-second guide portion 531) of the guide members are engaged with the respective corresponding support members (the roller housings 241). As a result, the transfer members (the primary transfer rollers 24) are pressed against the image bearing members (the photosensitive drums 20).

On the other hand, in the second state, as the moving member is moved, the second guide portions (the second-first guide portions 523) of the second guide members (the color guides 52) are engaged with the second support members (the roller housings 241M-241Y). As a result, the second transfer members (the primary transfer rollers 24M-24Y) are separated from the image bearing members. Moreover, the third guide portion (the second-second guide portion 532) of the first guide member (the black guide 53) is engaged with the first support member (the roller housing 241Bk). As a result, the pressing force of the first transfer member (the roller housing 241Bk) to the image bearing member is increased.

(7) According to the present disclosure, a force applied by a force applying member (the tension spring 151) presses a tension roller (the driven roller 143) against an inner circumferential surface of the intermediate transfer belt (the intermediate transfer belt 141). As a result, tension is exerted on the intermediate transfer belt. Moreover, an applied force adjuster (the applied force adjuster 18) sets the force applied by the force applying member to be greater in the second state than in the first state. Therefore, even when the second transfer members (the primary transfer rollers 24M-24Y) are separated from the second image bearing members (the photosensitive drums 20M-20Y), and therefore, the tension of the intermediate transfer belt decreases, the tension is suitably compensated for by the force applied by the force applying member. As a result, in the second state, the performance of transferring a single-color toner image to the intermediate transfer belt is further maintained, and the occurrence of banding is reduced or prevented.

(8) According to the present disclosure, in a third state in which no color toner images are transferred from the image bearing members (the photosensitive drums 20) to the intermediate transfer belt (the intermediate transfer belt 141), a switch section (the switch section 51) separates the transfer members (the primary transfer rollers 24) from the image bearing members. Moreover, the applied force adjuster (the applied force adjuster 18) sets the applied force to be smaller in the third state than in the first state. Therefore, tension exerted on the intermediate transfer belt is reduced. As a result, when no toner images are to be formed, a region of the intermediate transfer belt which is wrapped around the tension roller (the driven roller 143) may be prevented from being semi-permanently curled.

(9) According to the present disclosure, even when the performance of transferring a single-color toner image is varied due to changes in the tension exerted on the intermediate transfer belt (the intermediate transfer belt 141) and the performance of rotating the intermediate transfer belt, the transfer performance can be compensated for by adjusting the pressing force of the first transfer member (the primary transfer roller 24Bk) to the image bearing member (the photosensitive drum 20Bk). Therefore, the occurrence of a defect in the single-color toner image is suitably reduced or prevented. As a result, even when a single-color image is formed on a sheet (the sheet P), the image quality of the single-color image is stably maintained.

What is claimed is:

1. A transfer device comprising:

an intermediate transfer belt opposed to a plurality of image bearing members configured to bear toner images of different colors on circumferential surfaces thereof, and configured to cause the toner images of different colors to be transferred from the plurality of image bearing members to a surface thereof and superimposed together;

a housing configured to rotatably support the intermediate transfer belt;

a plurality of transfer members each configured to be pressed against a corresponding one of the plurality of image bearing members with the intermediate transfer belt being interposed therebetween, thereby transferring the toner images from the plurality of image bearing members to the intermediate transfer belt; and a switch section configured to, in a first state, cause the plurality of transfer members to be pressed against the plurality of image bearing members, and in a second state, cause a first one of the plurality of transfer members opposed to a first one of the plurality of image bearing members to be pressed against the first image bearing member, wherein the first state is a state in which the toner images of different colors are transferred from the plurality of image bearing members to the intermediate transfer belt and superimposed together, the second state is a state in which a single-color toner image is transferred from the first image bearing member to the intermediate transfer belt, the second state in which the switch section separates a second one of the plurality of transfer members opposed to a second one other than the first one of the plurality of image bearing members from the second image bearing member, the switch section includes a pressing force adjuster configured to change a pressing force of the first transfer member to the first image bearing member between the first and second states, the pressing force adjuster sets the pressing force of the first transfer member to be greater in the second state than in the first state, the transfer device further comprises a plurality of support members each configured to support a corresponding one of the plurality of transfer members for rotation, and slidable relative to the housing so that the pressing force of a corresponding one of the plurality of transfer members to a corresponding one of the plurality of image bearing members is varied, the switch section includes a plurality of guide members each engaged with a corresponding one of the plurality of support members, the plurality of guide members each include a first guide portion configured to place a corresponding one of the plurality of support members at a first position, and a second guide portion configured to place a corresponding one of the plurality of support members at a second position, the first position is where the corresponding one of the plurality of support members is opposed to a corresponding one of the plurality of image bearing members, and the second position is where the corresponding one of the plurality of support members is further separated from a corresponding one of the plurality of image bearing members than when located at the first position.

2. A transfer device according to claim 1, wherein the pressing force adjuster is a first one of the plurality of guide members, the first guide member is engaged with a first one of the plurality of support members, the first support member supports the first transfer member, the first guide member further includes a third guide portion provided between the first and second guide portions, and configured to place the first support member at a third position, and the third position is where the first support member is located closer to the first image bearing member than when located at the first position.

3. A transfer device according to claim 2, further comprising:

a moving member configured to support the plurality of guide members, and movable relative to the housing, wherein the moving member causes, in the first state, the first guide portions of the plurality of guide members to engage with the plurality of support members, and causes, in the second state, the second guide portion of a second one of the plurality of guide members to engage with a second one of the plurality of support members, and the third guide portion of the first guide member to engage with the first support member, the second support member supports the second transfer member, and the second guide member is engaged with the second support member.

4. A transfer device according to claim 3, wherein the plurality of support members each include a triangular first support portion, and a triangular second support portion opposed to the first support portion, and the plurality of guide members are each inserted between the first and second support portions of a corresponding one of the plurality of support members.

5. An image forming apparatus comprising:

the transfer device of claim 1;

the plurality of image bearing members; and a sheet transfer member configured to transfer, from the intermediate transfer belt to a sheet, the toner images of different colors transferred to and superimposed on the intermediate transfer belt or the single-color toner image transferred to the intermediate transfer belt.

6. A transfer device comprising:

an intermediate transfer belt opposed to a plurality of image bearing members configured to bear toner images of different colors on circumferential surfaces thereof, and configured to cause the toner images of different colors to be transferred from the plurality of image bearing members to a surface thereof and superimposed together;

a housing configured to rotatably support the intermediate transfer belt;

a plurality of transfer members each configured to be pressed against a corresponding one of the plurality of image bearing members with the intermediate transfer belt being interposed therebetween, thereby transferring the toner images from the plurality of image bearing members to the intermediate transfer belt; and a switch section configured to, in a first state, cause the plurality of transfer members to be pressed against the plurality of image bearing members, and in a second state, cause a first one of the plurality of transfer members opposed to a first one of the plurality of image bearing members to be pressed against the first image bearing member, wherein the first state is a state in which the toner images of different colors are transferred from the plurality of image bearing members to the intermediate transfer belt and superimposed together, the second state is a state in which a single-color toner image is transferred from the first image bearing member to the intermediate transfer belt, the second state in which the switch section separates a second one of the plurality of transfer members opposed to a second one other than the first one of the plurality of image bearing members from the second image bearing member, the switch section includes a pressing force adjuster configured to change a pressing force of the first transfer member to the first image bearing member between the first and second states, the pressing force adjuster sets the pressing force of the first transfer member to be greater in the second state than in the first state, the transfer device further comprises:

a tension roller, to which the intermediate transfer belt is wound, configured to exert tension on the intermediate transfer belt;

a force applying member configured to apply a force to the tension roller toward an inner circumferential surface of the intermediate transfer belt; and an applied force adjuster configured to change the force applied by the force applying member to the tension roller, and the applied force adjuster sets the force applied by the force applying member to be greater in the second state than in the first state.

7. A transfer device according to claim 6, wherein the switch section causes, in a third state, the plurality of transfer members to be separated from the plurality of image bearing members, the third state is a state in which none of the toner images of different colors is transferred from the plurality of image bearing members to the intermediate transfer belt, and the applied force adjuster sets the applied force to be smaller in the third state than in the first state.

8. A transfer device according to claim 7, further comprising:

a shaft bearing member configured to support a shaft of the tension roller, wherein the applied force adjuster includes a cam, and a force applying plate in contact with the cam, the force applying member is a spring, the spring is provided between the shaft bearing member and the force applying plate, and as the cam is rotated, the force applying plate is moved along a longitudinal direction of the spring.

9. A transfer device according to claim 8, wherein the cam has a first inner diameter portion, a second inner diameter portion, and a third inner diameter portion, in the first state, the first inner diameter portion is in contact with the force applying plate, in the second state, the second inner diameter portion is in contact with the force applying plate, whereby the force applying plate is located closer to the shaft bearing member than in the first state, and in the third state, the third inner diameter portion is in contact with the force applying plate, whereby the force applying plate is further separated from the shaft bearing member than in the first state.

10. An image forming apparatus comprising:

the transfer device of claim 6;

the plurality of image bearing members; and a sheet transfer member configured to transfer, from the intermediate transfer belt to a sheet, the toner images of different colors transferred to and superimposed on the intermediate transfer belt or the single-color toner image transferred to the intermediate transfer belt.

* * * * *